US009674927B1

(12) United States Patent
Williams

(10) Patent No.: US 9,674,927 B1
(45) Date of Patent: Jun. 6, 2017

(54) METHOD AND APPARATUS TO ADDRESS INADVERTENT DEACTIVATION OF DEVICES

(71) Applicant: GM Global Technology Operations LLC, Detroit, MI (US)

(72) Inventor: Darren C. Williams, Waterford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 15/135,631

(22) Filed: Apr. 22, 2016

(51) Int. Cl.
*H05B 37/02* (2006.01)

(52) U.S. Cl.
CPC ..... *H05B 37/0227* (2013.01); *H05B 37/0218* (2013.01)

(58) Field of Classification Search
CPC ..... H05B 37/0227; H05B 37/0218
USPC ..... 315/77
See application file for complete search history.

(56) References Cited

U.S. PATENT DOCUMENTS

2006/0044800 A1* 3/2006 Reime ..... B60Q 3/001 362/276
2013/0307610 A1* 11/2013 Salter ..... H03K 17/955 327/517

* cited by examiner

*Primary Examiner* — Daniel D Chang

(57) ABSTRACT

A method and apparatus for preventing inadvertent deactivation of an illumination device or other device are provided. The method includes detecting a first input to deactivate an active illumination device; determining whether the first input to deactivate is inadvertent based on context information; and performing a function if the determining determines that the first input to deactivate the active illumination device is inadvertent. The apparatus and method may be used in a vehicle or other apparatus to prevent inadvertent deactivation of devices at inopportune times.

16 Claims, 2 Drawing Sheets

METHOD AND APPARATUS TO ADDRESS INADVERTENT DEACTIVATION OF DEVICES

INTRODUCTION

Apparatuses and methods consistent with exemplary embodiments relate to deactivation prevention. More particularly, methods consistent with exemplary embodiments relate to preventing the inadvertent deactivation of devices.

SUMMARY

One or more exemplary embodiments address the above issues by providing a method and an apparatus capable of preventing inadvertent deactivation of a device. More particularly, one or more exemplary embodiments provide a method and an apparatus capable of preventing inadvertent deactivation of a device by using context information.

According to an aspect of an exemplary embodiment, a method for method of preventing inadvertent deactivation of an illumination device of a vehicle is provided. The method includes: detecting a first input to deactivate an active illumination device; determining whether the first input to deactivate is inadvertent based on context information of the vehicle; and performing a function if the determining determines that the first input to deactivate the active illumination device is inadvertent.

The vehicle context information may include at least one from among ignition status information, ambient light sensor information, and speed information.

The detecting the first input to deactivate the active illumination device may include detecting an input to a switch of an illumination device of the vehicle.

The performing the function may include outputting a notification to determine whether the deactivation of the active illumination device is intended.

The performing the function may further include detecting a confirmation input confirming that the deactivation of the active illumination device is intended and controlling to deactivate the active illumination device.

The performing the function may further include detecting a rejection input indicating that the deactivation of the active illumination device is unintended and disregarding the first input to deactivate the active illumination device.

The performing the function may include disregarding the first input to deactivate the active illumination device and keeping the illumination device active.

The performing the function may include detecting a second input to deactivate the active illumination device within a predetermined time of the first input; and in response to the detecting the second input within the predetermined time of the first input, deactivating the active illumination device.

The illumination device may include at least one from among a headlight or a taillight.

According to an aspect of another exemplary embodiment, a non-transitory computer readable medium comprising computer executable instructions executable by a processor to perform the method of preventing inadvertent deactivation of an illumination device of a vehicle is provided.

According to an aspect of another exemplary embodiment, an apparatus for preventing inadvertent deactivation of an illumination device is provided. The apparatus includes: at least one memory comprising computer executable instructions; and at least one processor configured to read and execute the computer executable instructions, the computer executable instructions causing the at least one processor to: detect a first input to deactivate an active illumination device; determine whether the first input to deactivate is inadvertent based on vehicle context information; and perform a function if it is determined that the first input to deactivate the active illumination device is inadvertent.

The vehicle context information may include at least one from among ignition status information, ambient light sensor information, and speed information.

The computer executable instructions may further cause the at least one processor is to detect the first input to deactivate the active illumination device by detecting an input to a switch of an illumination device of a vehicle.

The computer executable instructions may further cause the at least one processor is to perform the function by outputting a notification to determine whether the deactivation of the active illumination device is intended.

The computer executable instructions may further cause the at least one processor to perform the function by detecting a confirmation input confirming that the deactivation of the active illumination device is intended and controlling to deactivate the active illumination device.

The computer executable instructions may further cause the at least one processor to perform the function by detecting a rejection input indicating that the deactivation of the active illumination device is unintended and disregarding the first input to deactivate the active illumination device.

The computer executable instructions may further cause the at least one processor to perform the function by disregarding the first input to deactivate the active illumination device and keeping the illumination device active.

The computer executable instructions further cause the at least one processor further configured to: detect a second input to deactivate the active illumination device within a predetermined time of the first input; and in response to the detecting the second input within the predetermined time of the first input, deactivate the active illumination device.

The illumination device may be at least one from among a headlight or a taillight.

According to an aspect of another exemplary embodiment, a non-transitory computer readable medium comprising computer executable instructions executable by a processor to perform a method of preventing inadvertent deactivation of a device, the method comprising: detecting a first input to deactivate a device; determining whether the input to deactivate is inadvertent based on context information; and performing a function if the determining determines that the first input to deactivate the device is inadvertent while keeping the device active.

Other objects, advantages and novel features of the exemplary embodiments will become more apparent from the following detailed description of exemplary embodiments and the accompanying drawings.

DETAILED DESCRIPTION

Figure 1:
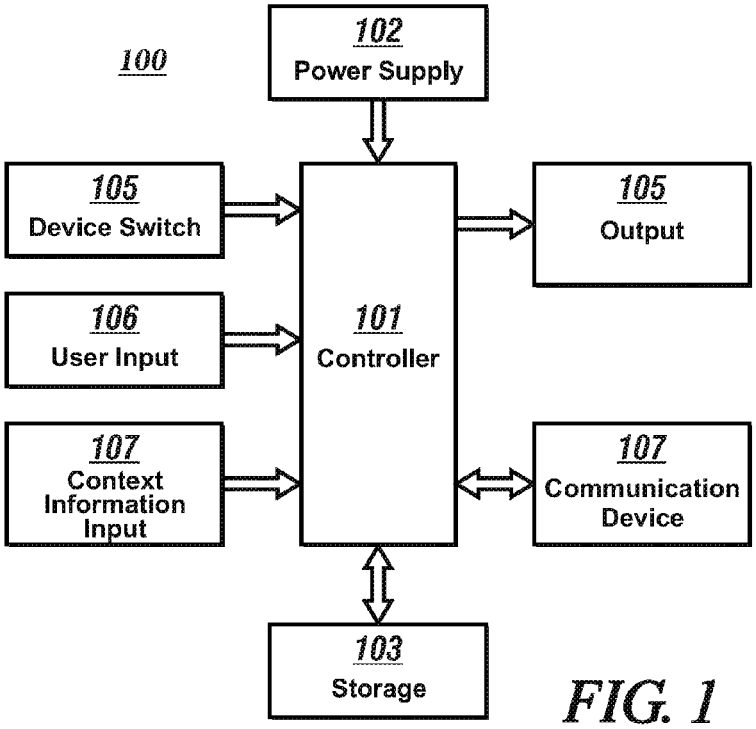
FIG. 1 shows a block diagram of an apparatus capable of preventing inadvertent deactivation of a device according to an exemplary embodiment.

Devices, for example illumination devices such as lights used to illuminate a path or area, may be activated and deactivated. The devices may be used alone or conjunction with a tool, a camera, a vehicle or other device. However, a device may be inadvertently deactivated at inopportune times creating difficulty for a user of a device.

An apparatus capable of preventing inadvertent deactivation of a device and method thereof will now be described in detail with reference to FIGS. 1-4 of the accompanying drawings in which like reference numerals refer to like elements throughout. The following disclosure will enable one skilled in the art to practice the inventive concept. However, the exemplary embodiments disclosed herein are merely exemplary and do not limit the inventive concept to exemplary embodiments described herein. Moreover, descriptions of features or aspects of each exemplary embodiment should typically be considered as available for aspects of other exemplary embodiments.

It is also understood that where it is stated herein that a first element is "connected to," "formed on," or "disposed on" a second element, the first element may be connected directly to, formed directly on or disposed directly on the second element or there may be intervening elements between the first element and the second element, unless it is stated that a first element is "directly" connected to, formed on, or disposed on the second element. In addition, if a first element is configured to "receive" information from a second element, the first element may receive the information directly from the second element, receive the information via a bus, receive the information via a network, or receive the information via intermediate elements, unless the first element is indicated to receive information "directly" from the second element.

Throughout the disclosure, one or more of the elements disclosed may be combined into a single device or combined into one or more devices. In addition, individual elements may be provided on separate devices.

FIG. 1 shows a block diagram of a deactivation prevention apparatus 100 according to an exemplary embodiment. As shown in FIG. 1, the deactivation prevention apparatus 100, according to an exemplary embodiment, includes a controller 101, a power supply 102, a storage 103, an output 104, a device switch 105, a user input 106, a context information input 107, and a communication device 108. However, the deactivation prevention apparatus 100 is not limited to the aforementioned configuration and may be configured to include additional elements and/or or omit one or more of the aforementioned elements.

The controller 101 controls the overall operation and function of the deactivation prevention apparatus 100. The controller 101 may control one or more of a storage 103, an output 104, a device switch 105, a user input 106, a context information input 107, and a communication device 108 of the deactivation prevention apparatus 100. The controller 101 may include one or more from among a processor, a microprocessor, a central processing unit (CPU), a graphics processor, Application Specific Integrated Circuits (ASICs), Field-Programmable Gate Arrays (FPGAs), state machines, and a combination of hardware, software and firmware components.

The power supply 102 provides power to one or more of the storage 103, the output 104, the device switch 105, the user input 106, the context information input 107, and the communication device 108 of the deactivation prevention apparatus 100. The power supply 102 may include one or more from a battery, an outlet, a capacitor, a solar energy cell, a generator, a wind energy device, an alternator, etc.

The storage 103 is configured to store information and configured to retrieve information used by the deactivation prevention apparatus 100. The storage 103 may be controlled by the controller 101 to store and retrieve context information such as context information of the vehicle, state information of the device switch 105, etc. The storage 103 may include one or more from among floppy diskettes, optical disks, CD-ROMs (Compact Disc-Read Only Memories), magneto-optical disks, ROMs (Read Only Memories), RAMs (Random Access Memories), EPROMs (Erasable Programmable Read Only Memories), EEPROMs (Electrically Erasable Programmable Read Only Memories), magnetic or optical cards, flash memory, cache memory, and other type of media/machine-readable medium suitable for storing machine-executable instructions.

The storage 103 may include a database that is configured to store the context information of the vehicle or other apparatus being used in conjunction with the deactivation prevention device. For example, an entry in the database may include one or more values of the context information of the vehicle or other device along with a setting indicating whether a deactivation that occurs in connection with the one or more values of the context information is intended or unintended. The storage 103 may also include the computer instructions configured to be executed by a processor to perform the functions of the deactivation prevention apparatus 100.

The output 104 outputs information in a visual, audible or haptic form. The output 104 may be controlled by the controller 101 to provide outputs to the user of the deactivation prevention apparatus 100. The output 104 may include one or more from among a speaker, a display, a heads up display, haptic feedback device, a vibration device, a tap-feedback device, a holographic display, etc.

The device switch 105 is configured to detect an activation and deactivation of a device such as an illumination device, a windshield wiper, a window, a traction control device, a powertrain device, a door lock, a door, a trunk, etc. The status of the device switch may be detected by and controlled by the controller 101 of the deactivation prevention apparatus 100. The device switch 105 may include one or more from among one or more from among a touchscreen, a keyboard, a soft keypad, a button, a motion detector, a voice input detector, a microphone, a camera, a trackpad, a mouse, a touchpad, etc.

The user input 106 is configured to provide inputs information and commands to the deactivation prevention apparatus 100. The user input 106 may be used to provide user inputs, etc. to the controller 101. The user input 106 may include one or more from among a touchscreen, a keyboard, a soft keypad, a button, a motion detector, a voice input detector, a microphone, a camera, a trackpad, a mouse, a touchpad, etc.

The context information input 107 is configured to receive context information such as vehicle context information and provide the information to the controller 101 of the deactivation prevention apparatus 100. The context information input 107 may be used to provide vehicle context information, etc. to the controller 101. The vehicle context information be received from sensors or devices that capture information about the vehicle, may be read from storage 103 where the vehicle context information is stored, or may be received via communication device 108.

The vehicle context information may be provided by sensors or devices such as one or more from among a Global Positioning System (GPS) device, a speedometer, an odometer, an engine sensor, an emission sensor, a transmission sensor, a tire pressure sensor, a door sensor, a trunk sensor, a window sensor, an interior/exterior temperature sensor, a barometric pressure sensor, an acceleration sensor, a gyroscopic sensor, a touch force or pressure sensor, a seat sensor, a passenger sensor, a collision sensor, an external object detector, an ultrasonic sensor, a radar sensor, a thermometer, an altimeter, an electronic control unit (e.g., an electronic controller, etc.), a car light activation sensor, a rain sensor, a snow sensor, a car key sensor, a car information and entertainment device (i.e., an infotainment device), a communication device, an ambient light sensor, etc.

The vehicle context information may include information on one or more from among an event associated with a vehicle, steering of a vehicle, turn indicator status, a speed of a vehicle, a location of a vehicle, an engine event or status, emission status, revolutions per minute of an engine, transmission status, tire pressure, door open/close status, trunk open/close status, window open/close status, interior/exterior temperature, barometric pressure, altitude of a vehicle, acceleration of a vehicle, user input, user applied pressure to an object or button in a vehicle, whether a passenger is in a seat, location and speed of external objects around the vehicle, which lights of a vehicle are activated, whether a car key is present in a vehicle, a currently displayed screen on a display in a vehicle, daytime or nighttime status, an amount of ambient light, whether it is raining, whether it is snowing, a status of a vehicle, a status of a setting of a vehicle, and a location of a function that is executable by the user.

The communication device 108 may be used by deactivation prevention apparatus 100 to communicate with various types of external apparatuses according to various communication methods. The communication device 108 may be used to receive context information such as vehicle context information to the controller 101 of the deactivation prevention apparatus 100.

The communication device 108 may include various communication modules such as a broadcast receiving module, a near field communication (NFC) module, a GPS module, and a wireless communication module. The broadcast receiving module may include a terrestrial broadcast receiving module including an antenna to receive a terrestrial broadcast signal, a demodulator, and an equalizer, and a digital multimedia broadcasting (DMB) module to receive and process a DMB broadcast signal. The NFC module is a module that communicates with an external apparatus located at a nearby distance according to an NFC method. The GPS module is a module that receives a GPS signal from a GPS satellite and detects a current location. The wireless communication module is a module that is connected to an external network by using a wireless communication protocol such as Wi-Fi or IEEE communication protocol and communicates with the external network. The wireless communication module may further include a mobile communication module that accesses a mobile communication network and performs communication according to various mobile communication standards such as $3^{rd}$ generation (3G), $3^{rd}$ generation partnership project (3GPP), long term evolution (LTE), Bluetooth, or Zigbee.

According to an exemplary embodiment, the controller 101 of the deactivation prevention apparatus 100 is configured to detect the status of the device switch 105. The controller 101 may detect a first input to device switch 105 to deactivate a device. The controller 101 may then determine whether the first input to deactivate is inadvertent based on context information. For example, the controller 101 may determine that the context information indicates that a vehicle is moving, the ignition of the vehicle is on, and it is dark outside, and thus, the first input to deactivate a device such as an illumination device is inadvertent. In this case, the context information may be vehicle context information such as ignition status information, ambient light sensor information, and speed information. The illumination device may be a headlight or a taillight.

The controller 101 may then control to perform a function if the determining determines that the first input to deactivate the device is inadvertent while keeping the device active. The performing of the function by the controller 101 may include outputting a notification to determine whether the deactivation of the active illumination device is intended. After the notification is output, the controller 101 may control to detect a confirmation input confirming that the deactivation of the active illumination device is intended and control to deactivate the active illumination device. Otherwise, the controller 101 may control to detect a rejection input indicating that the deactivation of the active illumination device is unintended and disregard the first input to deactivate the active illumination device.

The controller 101 may perform the function by simply disregarding the first input to deactivate the active illumination device and keep the illumination device active. In this case, the controller 101 may detect a second input to deactivate the active illumination device within a predetermined time of the first input, and in response to the detecting the second input within the predetermined time of the first input, deactivate the active illumination device.

According to another exemplary embodiment, the controller 101 may detect information from an ambient light sensor indicating it is dark outside and information on vehicle speed indicating that the speed of the vehicle is over a predetermined threshold. If the exterior lights (e.g., headlight or taillight) of the vehicle are off, the controller 101 may enable the exterior lights and display a message to the driver that the exterior lights have been enabled. If the exterior lights are on and the controller 101 detects an initiation of a function to turn off the exterior lights of the vehicle, the controller 101 may control to display a message informing the driver to initiate the function to turn off the exterior lights again in order to disable the lights and disable the lights in response to the driver initiating the function to turn off the exterior lights for a second time. If the driver does not initiate the function to turn off the exterior lights for a second time, the controller 101 disregards the initiation of a function to turn off the exterior lights of the vehicle.

Figure 2:
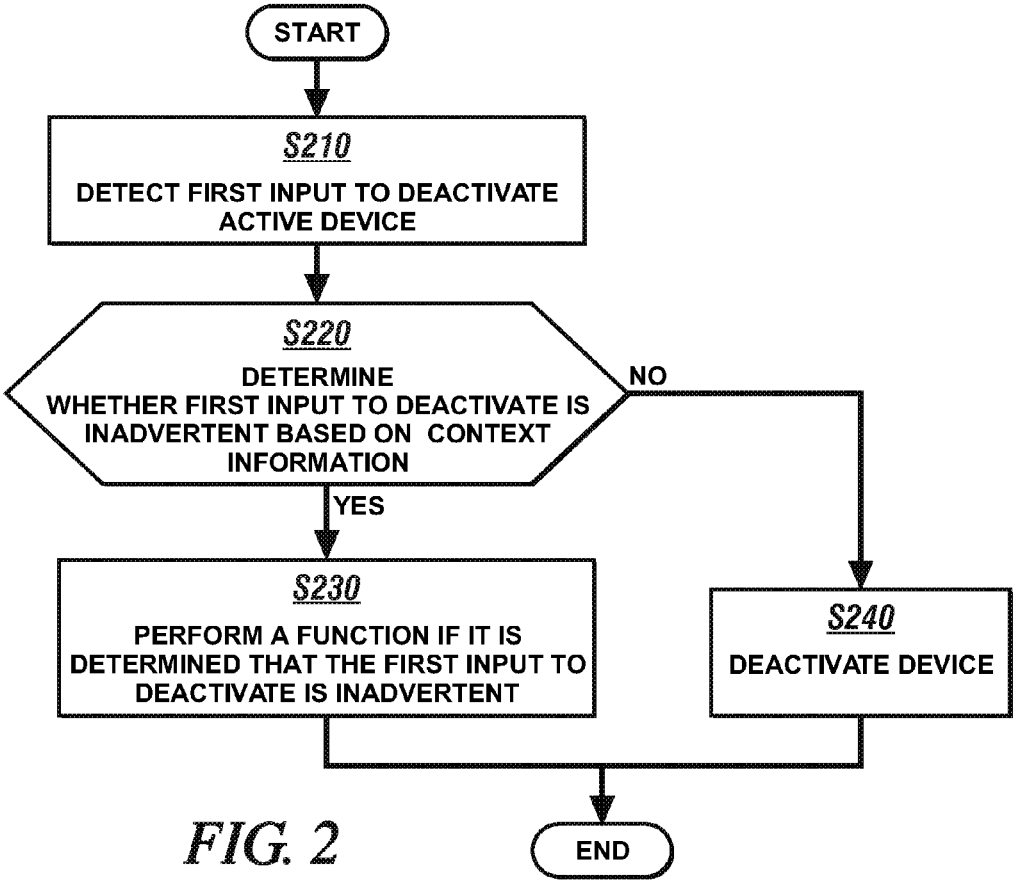
FIG. 2 shows a flowchart for a method of preventing inadvertent deactivation of a device according to an exemplary embodiment.

FIG. 2 shows a flowchart for a method of preventing inadvertent deactivation of a device according to an exemplary embodiment. The method of FIG. 2 may be performed by the deactivation prevention apparatus 100 or may encoded into a computer readable medium as instructions that are executable by a computer to perform the method.

Referring to FIG. 2, a first input to deactivate an active device is detected in operation S210. The active device may be an illumination apparatus or device such as a light, headlight, taillight, etc. The active device may also be a device such as a windshield wiper device, a power window, a radio, or a navigation system, etc. After the first input to deactivate the active device is detected, it is determined whether the first input to deactivate the device is inadvertent based on context information in operation S220. In this case, the context information may be vehicle context information. If it is determined that the first input to deactivate the active device is inadvertent or unintentional (operation S220—YES), a function is performed in operation S230. Otherwise, if it is determined that the first input to deactivate the active device is intentional or intended (operation S220—NO), the device is deactivated in operation S240.

The function that is performed in operation S230 may be to provide a notification indicating that the deactivation input may be inadvertent or warning the user of the deactivation of the device, and requesting further user input to continue to deactivate the device. The notification may be in the form of displayed information, audible information, or a chime, etc. As another example, the function that is performed in operation S230 may be to disregard the first input to deactivate the active device.

Figure 3:
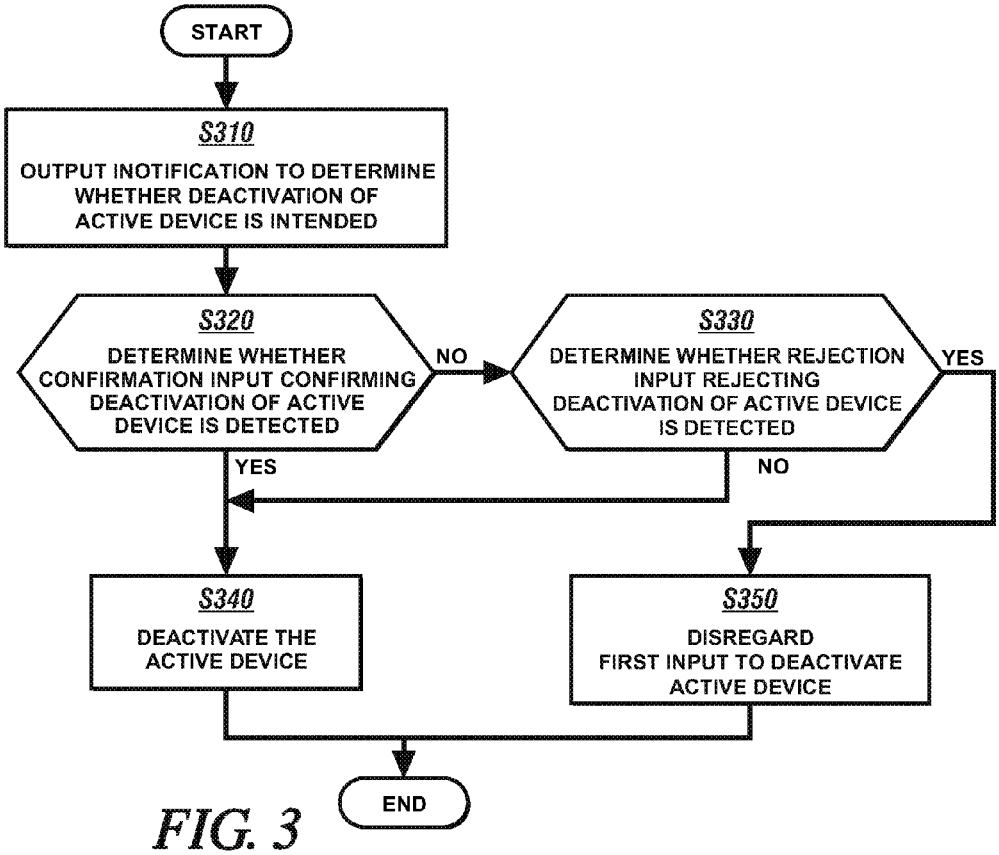
FIG. 3 shows a flowchart for a method of performing a function to prevent inadvertent deactivation of a device according to an aspect of an exemplary embodiment.

FIG. 3 shows a flowchart for performing a function to prevent inadvertent deactivation of a device according to an aspect of an exemplary embodiment. The method of FIG. 3 may be performed by the deactivation prevention apparatus 100 or may encoded into a computer readable medium as instructions that are executable by a computer to perform the method.

Referring to FIG. 3, the function to prevent inadvertent deactivation of a device may be performed by outputting a notification to determine whether the deactivation of the active device is intended in operation S310. In operation S320, it is determined whether a confirmation input confirming the deactivation of the active is detected. If the confirmation input is received (operation S320—YES), the active device is deactivated (operation S340). If the confirmation input is not received (operation S320—NO), it is determined whether rejection input rejecting deactivation of the active device is detected (operation S330). If the rejection input rejecting deactivation of the active device is detected (operation S330—YES), the first input to deactivate the active device is disregarded (operation S350). If the rejection input rejecting deactivation of the active device is not detected (operation S330—NOT), the active device is deactivated (operation S350).

Figure 4:
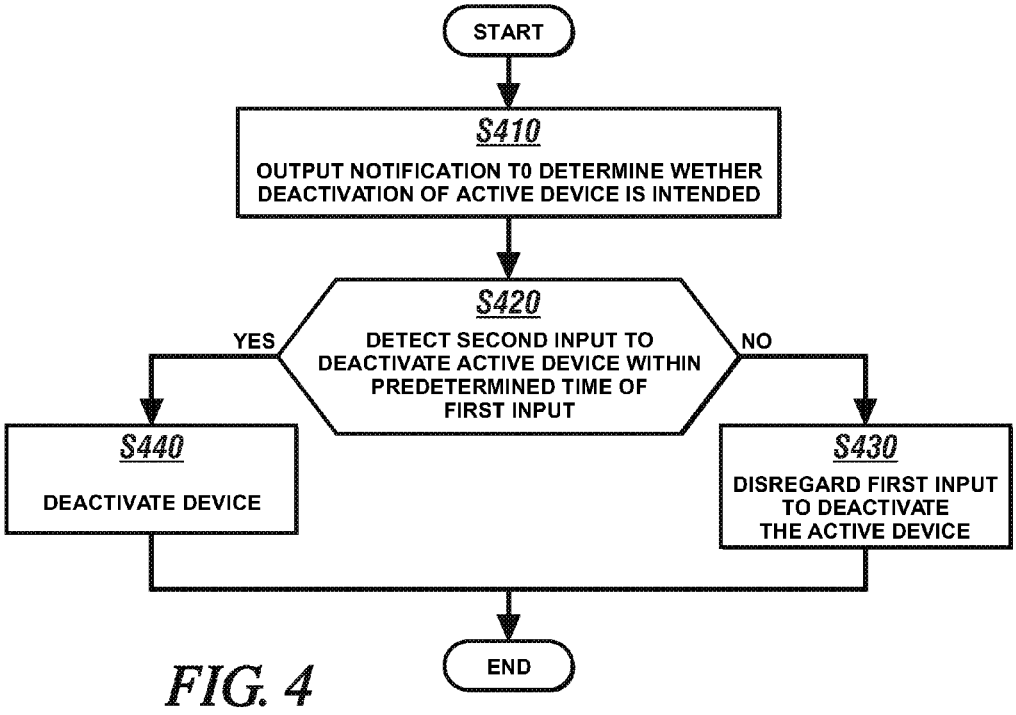
FIG. 4 shows a flowchart for a method of performing a function to prevent inadvertent deactivation of a device according to an aspect of another exemplary embodiment.

FIG. 4 shows a flowchart for performing a function to prevent inadvertent deactivation of a device according to an aspect of another exemplary embodiment. The method of FIG. 4 may be performed by the deactivation prevention apparatus 100 or may encoded into a computer readable medium as instructions that are executable by a computer to perform the method.

Referring to FIG. 4, by outputting a notification to determine whether the deactivation of the active device is intended in operation S410. In operation S420, it is determined whether a second input to deactivate the active device is detected within predetermined time of first input. If the second input to deactivate the active device is detected within the predetermined time (operation S420—YES), the active device is deactivated (operation S440). If the second input to deactivate the active device is not detected within the predetermined time (operation S420—NO), the first input to deactivated the active device is disregarded and the first device remains active (operation S430).

The processes, methods, or algorithms disclosed herein can be deliverable to/implemented by a processing device, controller, or computer, which can include any existing programmable electronic control device or dedicated electronic control device. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

One or more exemplary embodiments have been described above with reference to the drawings. The exemplary embodiments described above should be considered in a descriptive sense only and not for purposes of limitation. Moreover, the exemplary embodiments may be modified without departing from the spirit and scope of the inventive concept, which is defined by the following claims.

What is claimed is:

1. A method of preventing inadvertent deactivation of an illumination device of a vehicle, the method comprising:

detecting a first input to deactivate the active illumination device;

determining whether the first input to deactivate is inadvertent based on context information of the vehicle; and performing a function if the determining determines that the first input to deactivate the active illumination device is inadvertent, wherein the performing the function comprises:

disregarding the first input to deactivate the active illumination device and keeping the illumination device active;

detecting a second input to deactivate the active illumination device within a predetermined time of the first input; and in response to the detecting the second input within the predetermined time of the first input, deactivating the active illumination device.

2. The method of claim 1, wherein the vehicle context information comprises at least one from among ignition status information, ambient light sensor information, and speed information.

3. The method of claim 1, wherein the detecting the first input to deactivate the active illumination device comprises detecting an input to a switch of an illumination device of the vehicle.

4. The method of claim 1, wherein the performing the function comprises outputting a notification to determine whether the deactivation of the active illumination device is intended.

5. The method of claim 4, wherein the second input comprises a confirmation input confirming that the deactivation of the active illumination device is intended.

6. The method of claim 4, wherein the performing the function further comprises detecting a rejection input indicating that the deactivation of the active illumination device is unintended and disregarding the first input to deactivate the active illumination device.

7. The method of claim 1, wherein the illumination device comprises at least one from among a headlight or a taillight.

8. A non-transitory computer readable medium comprising computer executable instructions executable by a processor to perform the method of claim 1.

9. An apparatus for preventing inadvertent deactivation of an illumination device, the apparatus comprising:

at least one memory comprising computer executable instructions; and at least one processor configured to read and execute the computer executable instructions, the computer executable instructions causing the at least one processor to:

detect a first input to deactivate the active illumination device;

determine whether the first input to deactivate is inadvertent based on vehicle context information; and perform a function if it is determined that the first input to deactivate the active illumination device is inadvertent, wherein the computer executable instructions cause the at least one processor to perform the function by disregarding the first input to deactivate the active illumination device and keeping the illumination device active, and wherein the computer executable instructions further cause the at least one processor to:

detect a second input to deactivate the active illumination device within a predetermined time of the first input; and in response to the detecting the second input within the predetermined time of the first input, deactivate the active illumination device.

10. The apparatus of claim 9, wherein the vehicle context information comprises at least one from among ignition status information, ambient light sensor information, and speed information.

11. The apparatus of claim 9, wherein the computer executable instructions further cause the at least one processor to detect the first input to deactivate the active illumination device by detecting an input to a switch of an illumination device of a vehicle.

12. The apparatus of claim 9, wherein the computer executable instructions further cause the at least one processor is to perform the function by outputting a notification to determine whether the deactivation of the active illumination device is intended.

13. The apparatus of claim 12, wherein the second input comprises a confirmation input confirming that the deactivation of the active illumination device is intended.

14. The apparatus of claim 12, wherein the computer executable instructions further cause the at least one processor to perform the function by detecting a rejection input indicating that the deactivation of the active illumination device is unintended and disregarding the first input to deactivate the active illumination device.

15. The apparatus of claim 9, wherein the illumination device comprises at least one from among a headlight or a taillight.

16. A non-transitory computer readable medium comprising computer executable instructions executable by a processor to perform a method of preventing inadvertent deactivation of a device; the method comprising:

detecting a first input to deactivate the device;

determining whether the input to deactivate is inadvertent based on context information; and performing a function if the determining determines that the first input to deactivate the device is inadvertent while keeping the device active, wherein the performing the function comprises:

disregarding the first input to deactivate the active illumination device and keeping the illumination device active;

detecting a second input to deactivate the active illumination device within a predetermined time of the first input; and in response to the detecting the second input within the predetermined time of the first input, deactivating the active illumination device.

* * * * *